United States Patent [19]

Lizotte

[11] Patent Number: 4,848,116

[45] Date of Patent: Jul. 18, 1989

[54] PERMUTATION TYPE LOCK CONTROL ASSEMBLY

[75] Inventor: Edgar G. Lizotte, Winsted, Conn.

[73] Assignee: Ilco Unican Inc., Montreal, Canada

[21] Appl. No.: 196,060

[22] Filed: May 19, 1988

[51] Int. Cl.[4] ..... E05B 37/02

[52] U.S. Cl. ..... 70/306; 70/307; 70/315

[58] Field of Search ..... 70/209, 210, 213, 214, 70/287, 288, 293, 301, 304, 305, 306, 307, 315, 316

[56] References Cited

U.S. PATENT DOCUMENTS

| | | | |
|---|---|---|---|
| 3,040,556 | 6/1962 | Rosenhagen | 70/30 C X |
| 3,115,765 | 12/1963 | Fengler | 70/315 |
| 3,411,330 | 11/1968 | Atkinson | 70/71 |
| 4,027,508 | 6/1977 | McGourty | 70/214 |
| 4,111,017 | 9/1978 | Barnette | 70/293 |
| 4,445,348 | 5/1984 | Saitoh | 70/312 |

*Primary Examiner*—Robert L. Wolfe

*Attorney, Agent, or Firm*—Fleit, Jacobson, Cohn, Price, Holman & Stern

[57] ABSTRACT

A timing gear arrangement, an idler gear arrangement and a code gear arrangement are mounted in parallel with each other such that the timing gears are in mesh with the idler gears which are in mesh with the code gears. Push buttons are associated with each of the idler gears on the idler gear arrangement, and each push button is connected to a slider plate which will cause its associated code gear to rotate a predetermined distance when the push button is depressed. Further, the code gear arrangement is removably mounted in the lock control assembly.

11 Claims, 9 Drawing Sheets

PERMUTATION TYPE LOCK CONTROL ASSEMBLY

BACKGROUND OF INVENTION

1. Field of the Invention

The invention relates to an improved control assembly for a permutation type lock. More specifically, the invention relates to such a novel control assembly which permits a low profile lock. The invention also relates to such a control assembly having a removable code gear arrangement.

2. Description of Prior Art

Control assemblies for permutation type locks are known in the art as illustrated in, for example, U.S. Pat. No. 3,040,556, Rosenhagen, June 26, 1962. In the Rosenhagen patent, the control assembly includes a code gear arrangement, an idler gear arrangement and a timing gear arrangement. Push buttons are provided to punch in a code, and a plunger extends from each push button to move a respective code gear of the code gear arrangement when the push button is pushed. As the plunger moves in the same direction as the movement of the push button, a control assembly for a permutation lock made in accordance with the teachings of the Rosenhagen patent must have a relatively high profile.

Furthermore, with a control assembly as taught in Rosenhagen, if the combination is "lost" (i.e., it is forgotten), then the entire assembly must be taken apart to reset the assembly.

U.S. Pat. No. 3,115,765, Fengler, Dec. 31, 1963, makes improvements to the control assembly of Rosenhagen. However, it does not alter the performance insofar as the above-mentioned disadvantages.

U.S. Pat. No. 3,411,330, Atkinson, Nov. 19, 1968, teaches a system wherein the combination is dialled instead of using push buttons.

U.S. Pat. No. 4,027,508, McGourty, June 7, 1977 provides a push-button combination lock wherein a new combination can be set without dismantling the lock.

U.S. Pat. No. 4,111,017, Barnette, Sept. 5, 1978, teaches a manually operated coded switch. After attempting a code, the switch's code wheels must be returned to their zero position before another try can be made.

U.S. Pat. No. 4,445,348, Saitoh, May 1, 1984, teaches a combination lock capable of being set in any desired combination of numbers without the use of tools.

SUMMARY OF INVENTION

It is an object of the invention to provide a control assembly for a permutation type lock with which a low profile permutation type lock can be made.

It is a further object of the invention to provide a control assembly for a permutation type lock wherein the code gear arrangement is removable.

In accordance with the invention, there is provided a permutation type lock control assembly. The assembly includes a timing gear arrangement having a plurality of timing gears mounted on a timing gear shaft for rotation with the timing gear shaft. An idler gear arrangement, having a plurality of idler gears equal to the plurality of timing gears is mounted on an idler gear shaft for rotation about the idler gear shaft. Each of the idler gears is aligned with a respective one of the timing gears. A code gear arrangement includes a plurality of code gears equal to the plurality of timing gears and is mounted on a code gear shaft for rotation about the code gear shaft. Each of the code gears is alignable with a respective one of the idler gears. Also provided are a plurality of push buttons equal to the plurality of timing gears, each of the push buttons being associated with a respective one of the idler gears. Means connect each of the push buttons to their associated code gears to rotate the code gears a predetermined distance when the associated push button is depressed. Each code gear is rotatable by a motion substantially perpendicular to the motion of its associatated push button when its associated push button is depressed.

In accordance with a further embodiment of the invention, the code gear arrangement is removably mounted in the lock control assembly.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
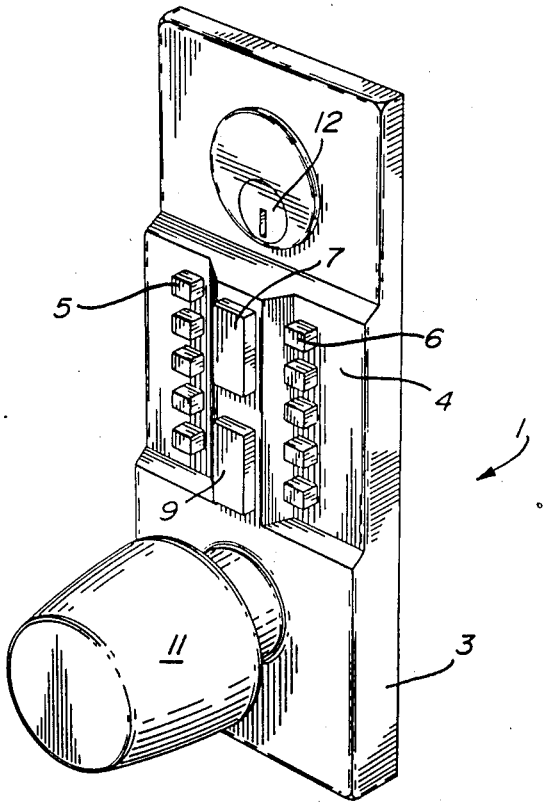
FIG. 1 is a perspective view of a permutation type lock with the novel control assembly.

Referring to FIG. 1, a permutation lock 1 made with the control assembly in accordance with the invention comprises an outer casing 3 having a push button panel 4. The push buttons comprise a left-hand row of code push buttons 5 and a right-hand row of code push buttons 6. Code push buttons 5 and 6 are identical to each other but have been differently identified herein for purpose of facilitating later descriptions. The push buttons will include indicia as shown. Although ten buttons are illustrated in the present application, the invention can be used with a lesser or larger amount of buttons.

Push button 7 is a push to clear button and push button 9 is a push to open button. Door knob 11 serves to actuate the lock mechanism, and keyhole 12 provides a bypass in the event that the combination is not available. All of the external elements seen in FIG. 1 are, of course, well known in the art.

Figure 2:
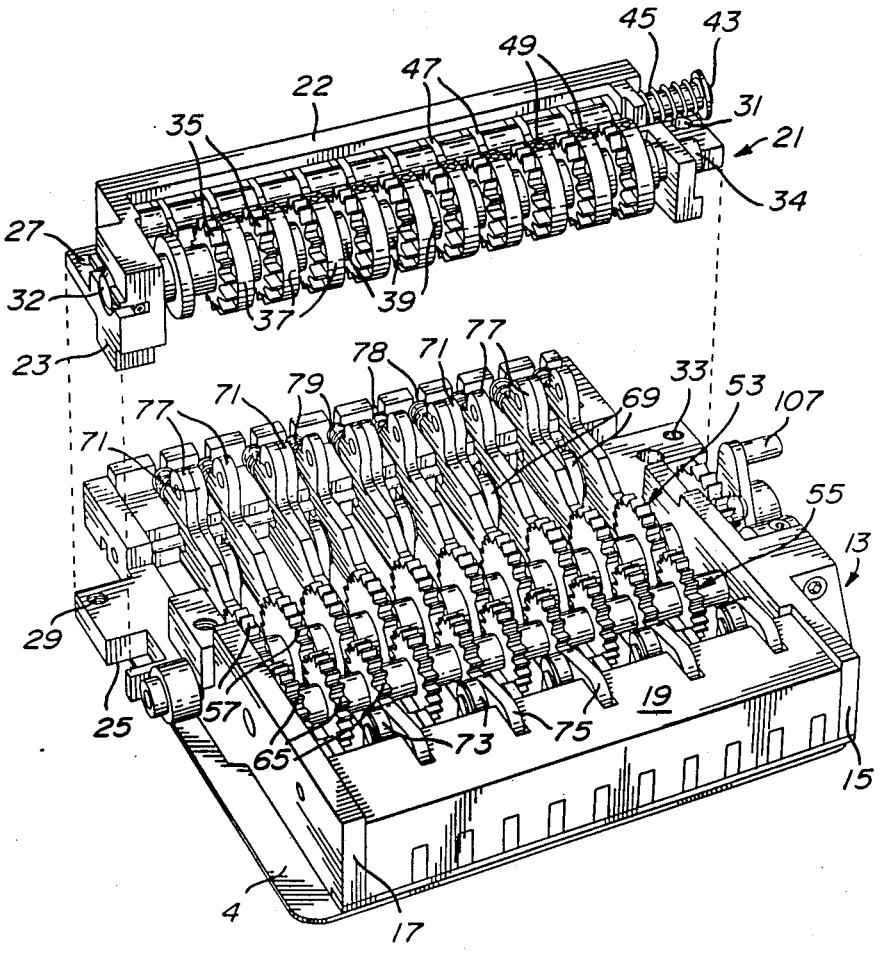
FIG. 2 is a perspective view of the control assembly.

Turning now to FIG. 2, the control assembly is housed in an enclosure, illustrated generally at 13, and comprising side walls 15 and 17 and end block 19.

Shown in exploded view is the removable code gear arrangement illustrated generally at 21. The arrangement comprises a housing 22 which is designed for precision alignment in enclosure 13. For this purpose, the housing 22 comprises fingers 23 (only the left-hand one is shown) which extend into openings 25 (again only the left-hand one is shown) when the housing 22 is mounted on the enclosure 13. Housing 22 is removably attached to enclosure 13 by screws extending through aligned screw holes 27,29 and 31,33. Thus, when the housing 22 is mounted on the enclosure 13, the code gear arrangement is in precision alignment with the other elements of the control assembly.

The code gear arrangement comprises actuators 32 and 34 for insetting a code as will be described below. It also includes a plurality of code gears 35 (ten are illustrated in FIG. 2 for operation with the ten push buttons illustrated in FIG. 1), and a like plurality of associated code discs 37. As can be seen, a separate code disc is associated with each code gear.

Figure 3:
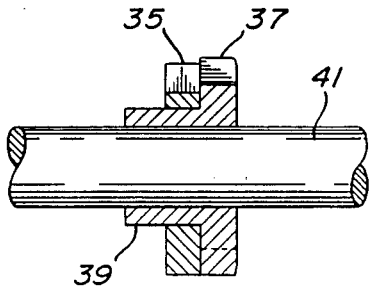
FIG. 3 is a fragmentary view of the code gear arrangement.

Spacers 39 separate each code gear/code disc assembly combinations from adjacent combinations, and the code gears, code discs and spacers are mounted on code gear shaft 41 as seen in FIG. 3. As will be clear from FIG. 3, the code gears 35 are rotatable relative to the shaft 41, and the code discs 37 rotate with the code gears 35. (Thus, the code gear code disc and spacer could be formed as an integral unit as by sintering or die casting). Thus, the code gear/code disc combinations are rotatable about the code gear shaft 41, however, they are not capable of longitudinal motion along code gear shaft in view of the spacers 39.

The code gear arrangement also includes an unlocking shaft 43 which is spring biassed outwardly by spring 45. Associated with the unlocking shaft 43 are a plurality of alignment tabs 47. The plurality of alignment tabs is equal to the plurality of code gears (ten in the illustrated embodiment). The alignment tabs are also illustrated in FIGS. 11 and 12.

Figure 12:
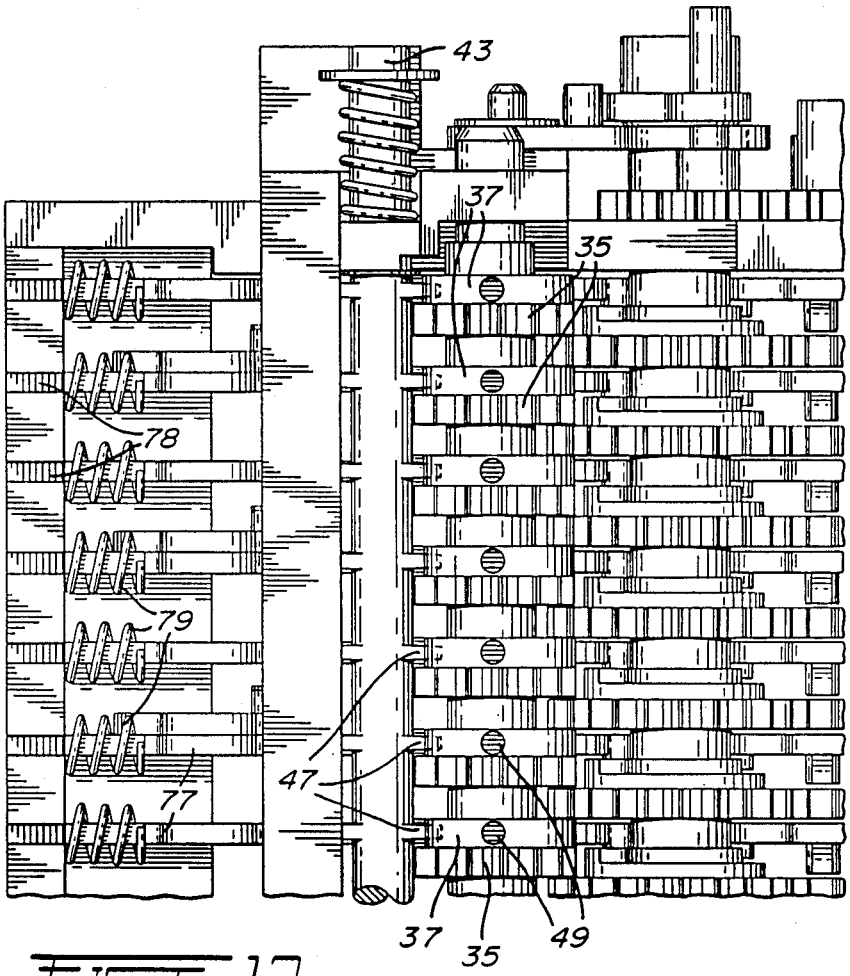
FIG. 12 is a top view of FIG. 3 illustrating how a new combination can be inserted.
Figure 11:
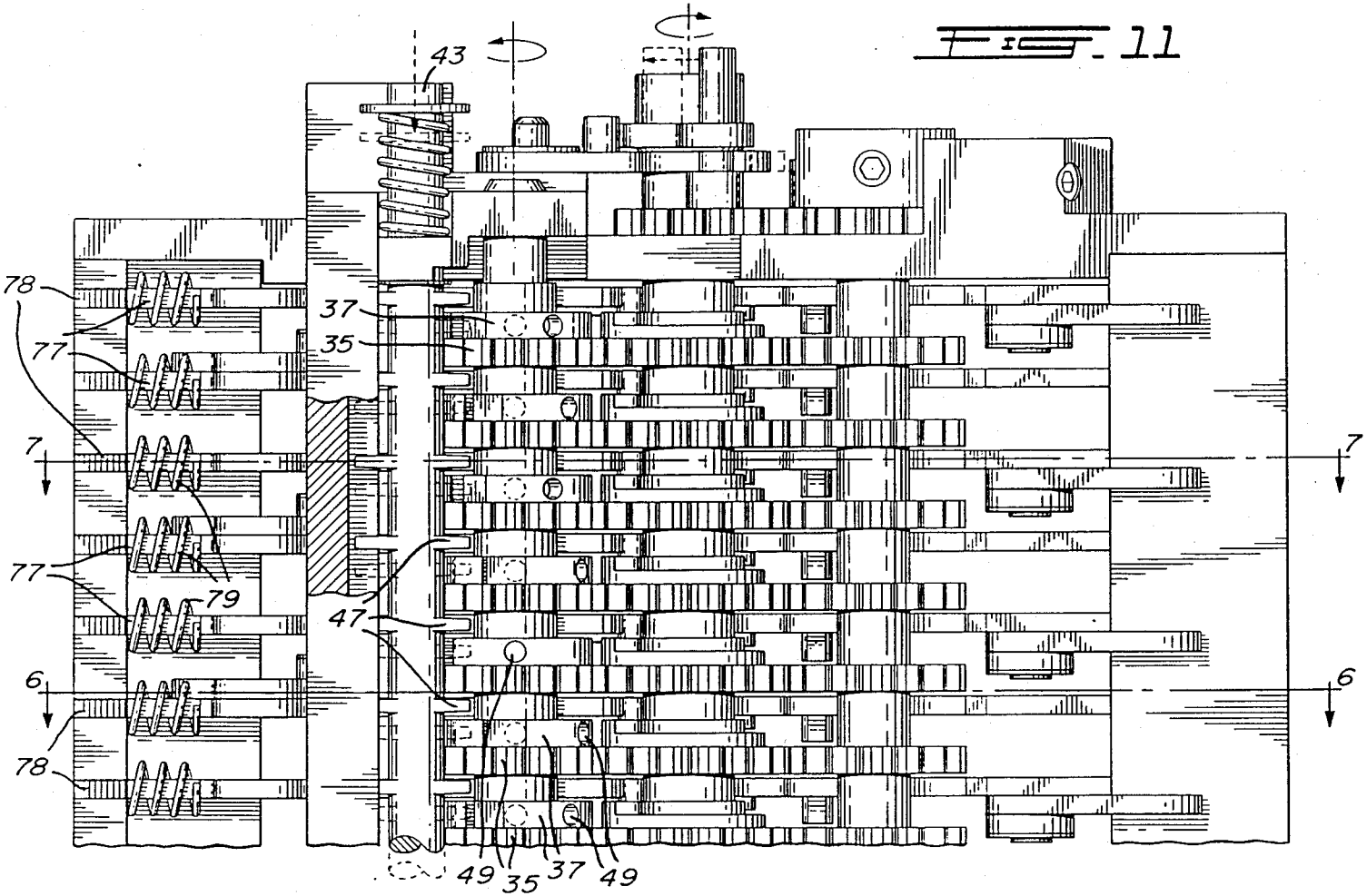
FIG. 11 is a top view of FIG. 3 illustrating how the unlocking shaft can be moved when the correct combination is set.

The code discs also include alignment dots 49 which are also illustrated in FIGS. 11 and 12.

Figure 6:
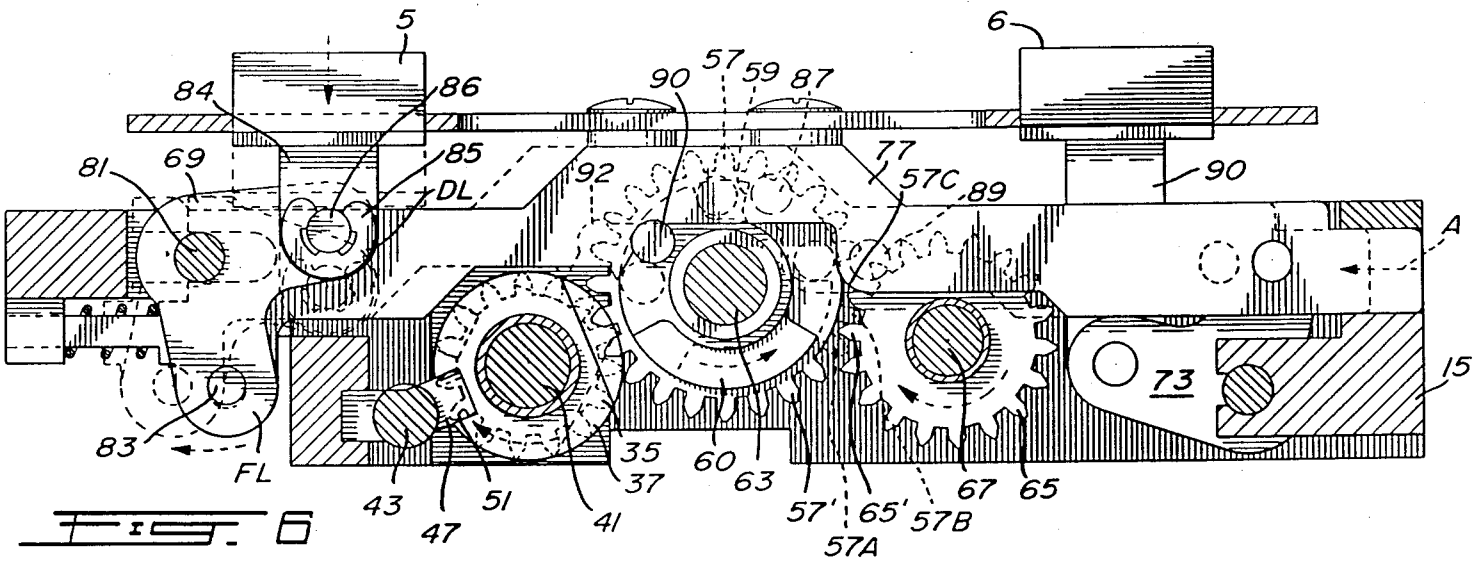
FIGS. 6 and 7 are sectional views illustrating the operation of the sliders.
Figure 7:
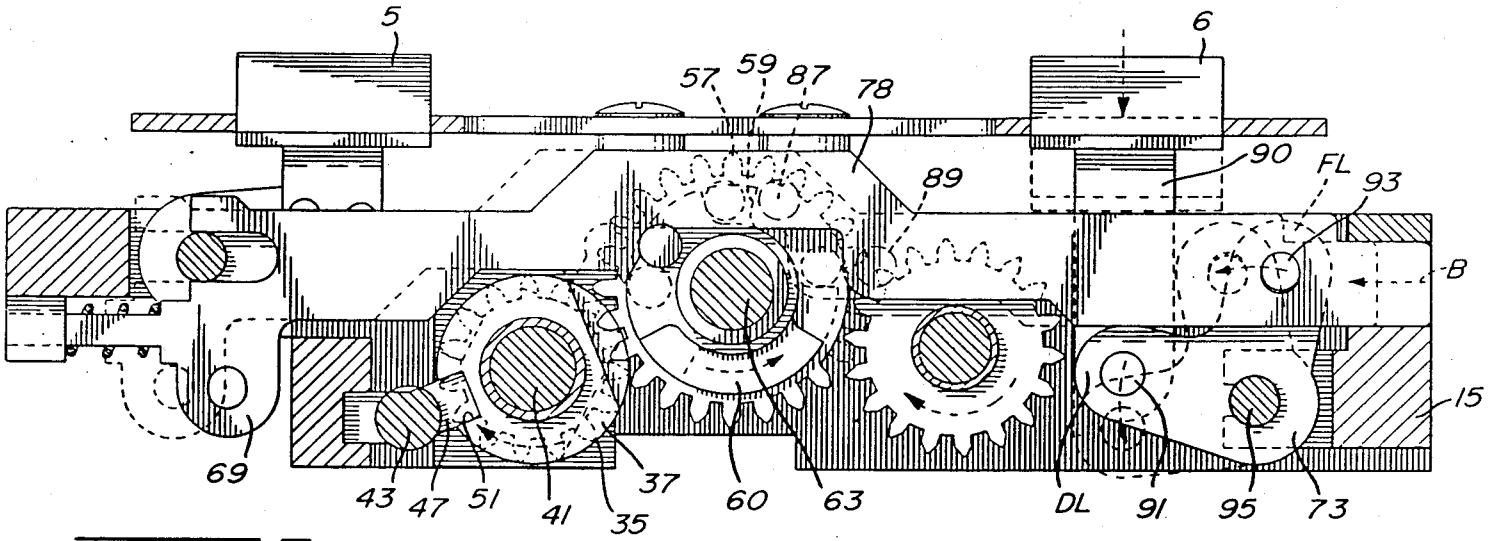

Each code disc also includes an alignment window 51, shown in FIGS. 6 and 7, and the alignment windows 51 of all code discs 37 are in the same position on the disc 37 relative to the alignment dots 49.

When all of the alignment windows 51 of the code discs are in alignment (as in FIG. 12), all of the alignment dots are also in alignment. This is the unlocking or combination setting condition of the assembly.

When the alignment windows 51 are misaligned, then it will not be possible to move unlocking shaft 43 leftwardly to engage and actuate a lock. This is because the alignment tabs will abut one or more of the code discs to be prevented from moving leftwardly.

In the same way, it would not be possible to move code gear arrangement rightwardly by actuating actuator 32 as the discs would now abut the alignment tab to arrest the rightward movement of the code gear arrangement.

However, when the alignment windows are in alignment, the alignment windows 51 clear a path for the alignment tabs 47 so that unlocking shaft 43 can be moved leftwardly. In the same way, by actuation of actuator 32, the code gear arrangement can be moved rightwardly as an empty spaced alignment window 51 is adjacent each alignment tab 47.

Figure 4:
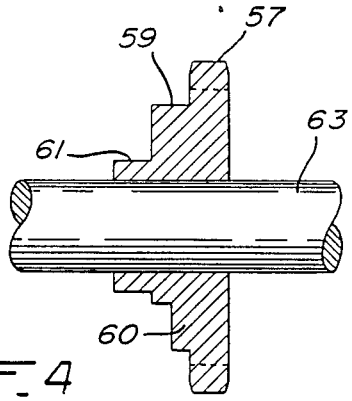
FIG. 4 is a fragmentary view of the idler gear arrangement.

Returning to FIG. 2, the control assembly also includes an idler gear arrangement, illustrated generally at 53, and a timing gear arrangement, illustrated generally at 55. The idler gear arrangement includes a plurality of idler gears 57, equal to the plurality of code gears 35. As seen in FIG. 4, each idler gear 57 includes an idler gear pick-up 59, an idler gear overtravel protection 60 (both 59 and 60 can also be seen in FIGS. 6 and 7), and a spacer 61 all mounted on idler gear shaft 63. From FIG. 4, it can be seen that the idler gears are rotatable relative to the shaft 63. However, once again, because of the spacer 61, the idler gears cannot travel longitudinally along the idler gear shaft 63.

Figure 5:
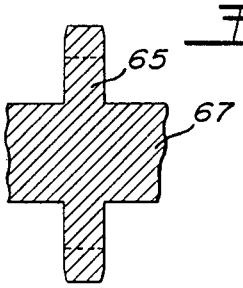
FIG. 5, which is on the same sheet of drawings as FIG. 12, is a fragmentary view of the timing gear arrangement.

Timing gear arrangement 57 comprises a plurality of timing gears 65 equal to the plurality of code gears 35. As seen in FIG. 5, the timing gear is formed integrally with the timing gear shaft 67 so that the timing gears 65 rotate with the timing gear shaft 67.

Returning again to FIG. 2, the control assembly comprises a plurality of left-hand cranks 69, the number of left-hand cranks being equal to half the number of code gears. The left-hand cranks 69 are supported by supports 71.

The control assembly also includes a plurality of right-hand cranks 73 supported by supports 75. The number of right-hand cranks, generally speaking, is equal to the number of code gears less the number of left-hand cranks. In the illustrated embodiment, there are five left-hand cranks and five right-hand cranks.

Extending across the control mechanism are a plurality of left-hand sliding plates 77 (the plates are referred to as left-hand plates because they are associated with the left-hand cranks 69) and a plurality of right-hand sliding plates 78 (which are associated with the right-hand cranks 73). In the illustrated embodiment, there are five left-hand sliding plates 77 and five right-hand sliding plates 78. The sliding plates have been identified as right-hand sliding plates or left-hand sliding plates to facilitate the description herein. However, in spite of their different names, each sliding plate is identical with every other sliding plate so that any sliding plate can be replaced by any other sliding plate or by any replacement plate. Each sliding plate is spring biassed inwardly by spring means 79 which are also illustrated in FIGS. 11 and 12.

As can be seen in FIG. 2, each idler gear is associated with a respective code gear, a respective timing gear, a respective sliding plate, and a respective crank, to form an assembly set. There are ten such assembly sets in the illustrated embodiment. The teeth of each idler gear are meshed with the teeth of their respective code gears. As will also be seen below, the teeth of each idler gear will mesh with the teeth of their respective timing gears after the idler gears have been rotated two teeth spaces from their home position.

FIG. 6 illustrates the structural relationship between the left-hand cranks and the left-hand sliding plates, and the operation of the left-hand sliding plates. Turning to FIG. 6, each left-hand crank 69 is mounted for pivoting about a pivot point 81. Each left-hand crank 69 is connected to a respective left-hand sliding plate 77 at 83.

Each left-hand push button 5 has stem 84 mounting a retaining ring 85. The retaining ring is attached to stud 86 on left-hand crank 89 to attach the left-hand crank 89 to the stem 84.

As can be seen, the cranks are somewhat boomerang shaped having a driven leg DL and a free moving leg FL. When push button 5 is moved downwardly, the driven leg is moved downwardly to its position shown in dotted lines. The free moving leg will be moved to the left to its position shown in dotted lines. As the free moving leg is connected to the sliding plate 77 at 83, the sliding plate will also move leftwardly to its position shown in dotted lines in FIG. 6.

Mounted on sliding plate 77 is pick-up stud 87 which is adapted to engage with idler gear pick-up 57, and overtravel pick-up stud 89, which is adapted to engage with idler gear overtravel protection 60. When plate 77 moves to the left, stud 87 engages idler gear pick-up 59 and rotates idler gear 57 counter-clockwise to the position shown in dotted lines in FIG. 6. At the same time, stud 89 moves leftwardly into its position shown in dotted lines, and it engages idler gear overtravel protection 60 to prevent idler gear 57 from overtraveling.

As can be seen in FIG. 6, when the idler gear rotates in a counter-clockwise direction, it will force its associated code gear to rotate in a clockwise direction. It will also force its associated timing gear, and therefore the timing shaft with it, to rotate in a clockwise direction, after the idler gear has engaged its respective timing gear as will be explained below.

Mounted on idler gear 57 is a zero, or home positioning, stud 90. When the mechanism is totally cleared to zero, sutd 90 intercepts plate 77 and engages opening 92 therein to lock-in gear 57.

Turning now to FIG. 7, the right-hand push button 6 also has a stem 90, and the driven leg DL of right-hand crank 73 is connected to the stem 90 at connection 91 so that DL will move with the stem 90. Free moving leg FL of right-hand crank 73 is connected to right-hand plate 78 at 93, and crank 73 is mounted for pivoting about 95. Accordingly, when the push button 6 is pushed downwardly, DL will move downwardly to the position shown in dotted lines, and FL will move to the left to its position shown in dotted lines so that, once again, pick-up stud 87 on plate 78 will engage idler gear pick-up 59 to rotate idler gear 57 in a counter-clockwise direction.

It can therefore be seen that, pushing either a right-hand or a left-hand push button will cause its associated plate to move leftwardly (as seen in FIGS. 6 and 7), and cause its associated idler gear to rotate in a counter-clockwise direction.

Figure 8:
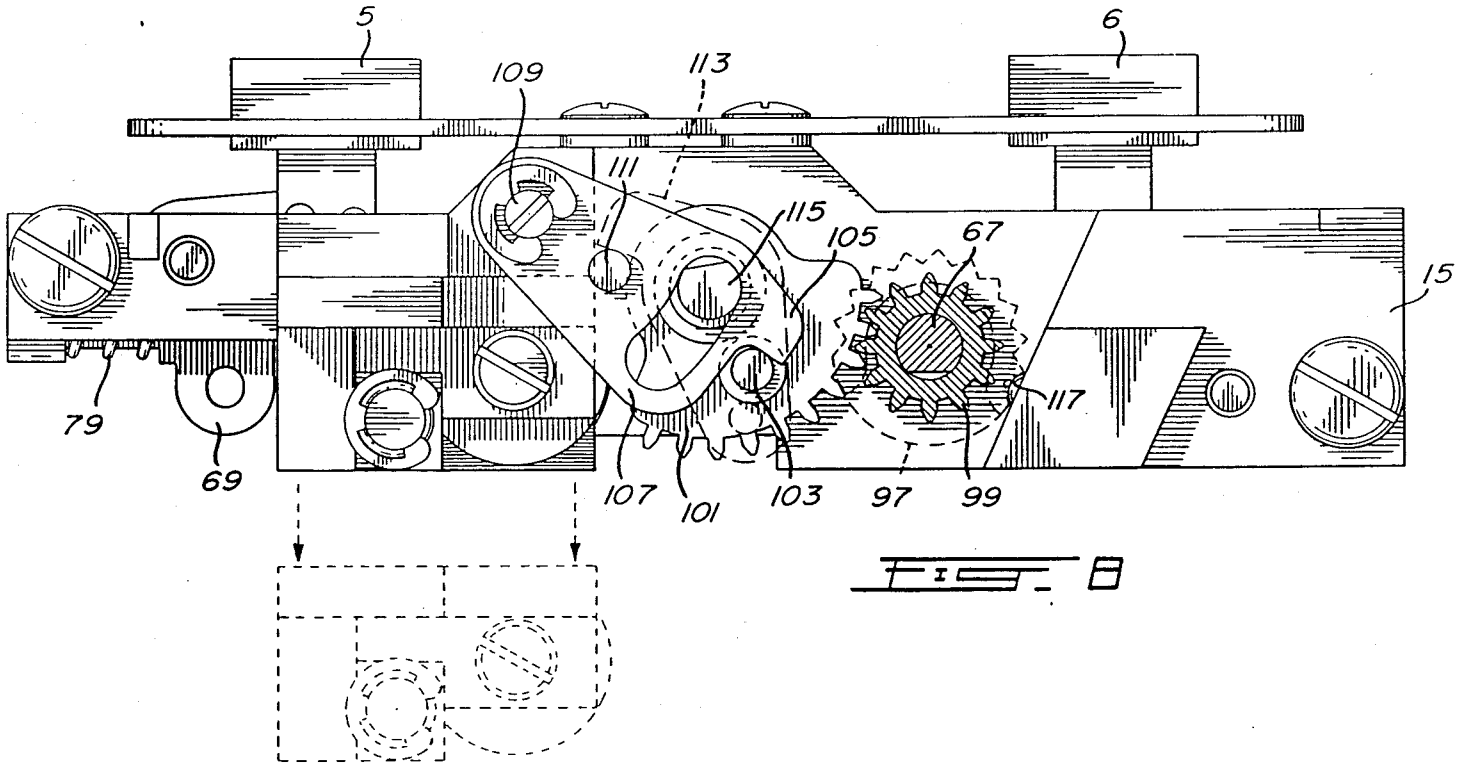
FIGS. 8 and 9 illustrate the action of the clearing arm.

Turning now to FIG. 8, mounted on timing gear shaft 67 is a detent disc 97 and a detent gear 99. The detent gear 99 meshes with driver gear sector 101 which mounts a stud 103. Finger 105 of clearing arm 107 engages the stud 105. Clearing arm 107 is mounted for pivoting about pivot point 109 and mounts a stud 111. Stud 111 is engaged by clearing arm drive 113 which pivots around 115. 115 also serves as a pivot for driven gear sector 101, and a guide for clearing arm 107.

Figure 9:
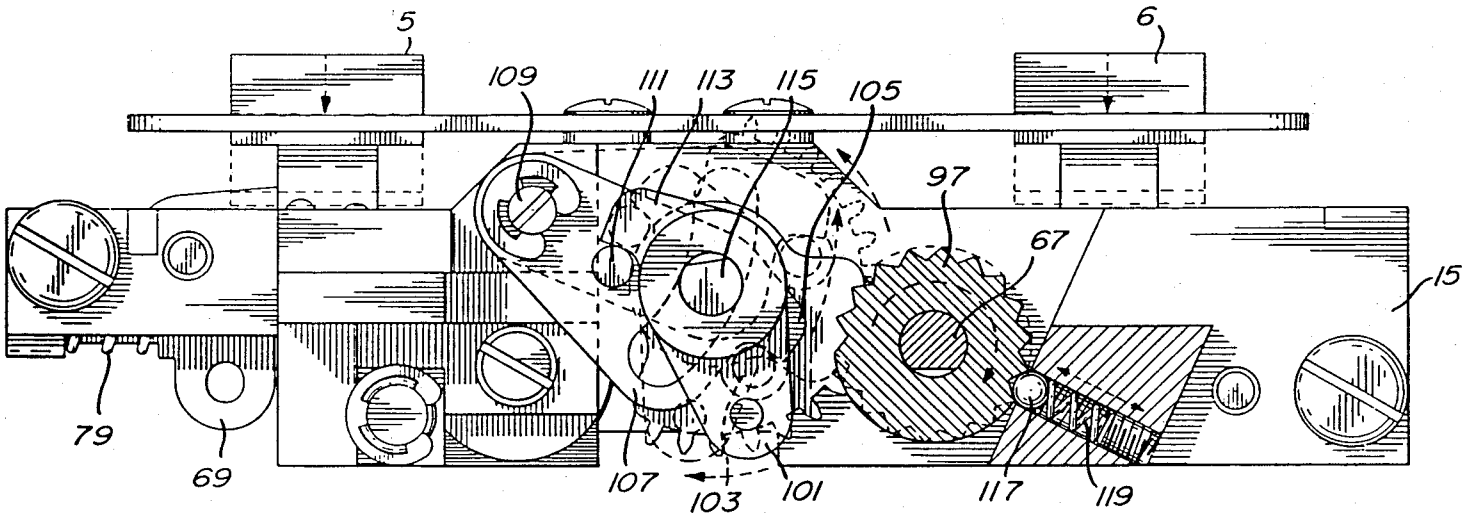
Figure 10:
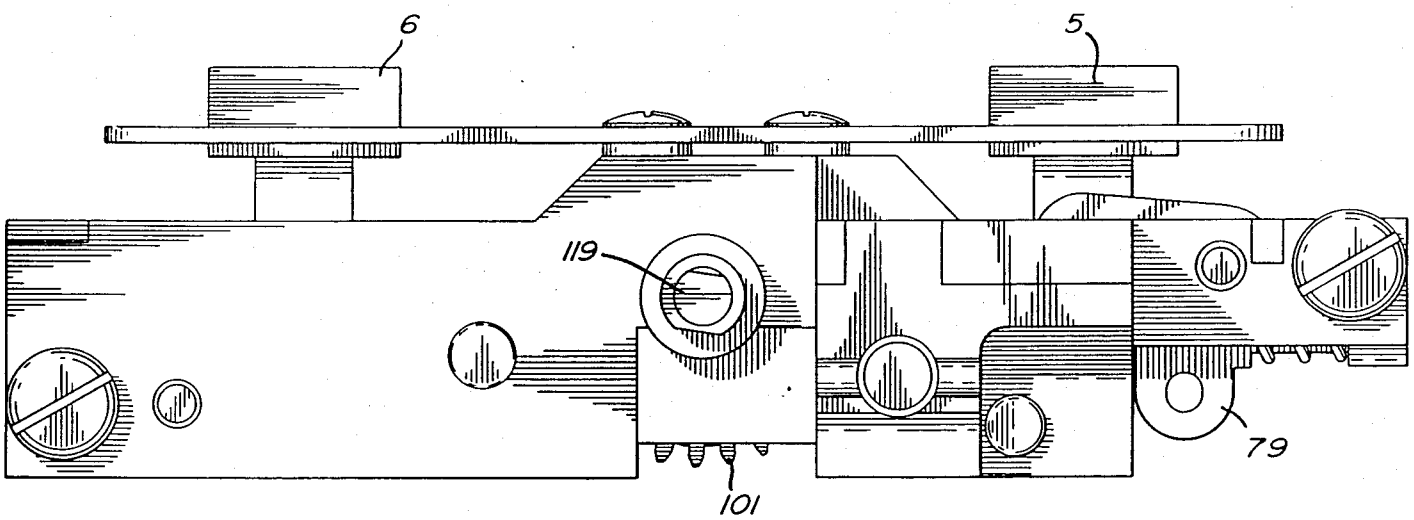
FIG. 10 is an end view illustrating the position of the transfer shaft connected to the clearing arm on the other side.

Referring to both FIGS. 8 and 9, the teeth of detent disc 97 are engaged by detent ball 117 which is spring biassed towards the detent disc by spring 119.

As the detent disc can be moved only by a positive force which overcomes the spring bias of spring 119, and as the detent disc is connected to the timing gear shaft 67, and as the timing gear shaft is connected, by meshing of the timing gears, to respective ones of the idler gears, and, by meshing of the idler gears to respective ones of the code gears, to all of the timing gears, idler gears and code gears, inadvertent movements of the gears is prevented by the detent arrangement.

Referring to FIG. 6, each idler gear has a gap in the teeth created by the removal of three of the teeth. In FIG. 6, the spaces 57*a*, 57*b* and 57*d* provide this gap by removal of the teeth therefrom. In the "home" condition, the teeth of the idler gears 57 are not meshed with the teeth of the timing gears 65. Tooth 57' of the idler gear 57 is one tooth space away from meshing with the teeth of the timing gear 65.

When push button 5 is depressed, as seen in FIG. 6, stem 84 will move downwardly taking with it driven leg DL of crank 69 so that the free end will move leftwardly into the position shown in dotted lines. As free moving leg FL is connected to sliding plate 77 at 83, sliding plate 77 will also move leftwardly to the position shown in dotted lines.

In a like manner, and referring to FIG. 7, when push button 6 is depressed, stem 90 will once again move downwardly and take with it driven leg DL of crank 73. The driven leg DL will then occupy the position shown in dotted lines. The free moving leg DL will move leftwardly and also occupy the position shown in dotted lines. As the free moving leg FL of crank 73 is connected to sliding plate 78 at 93, the sliding plate will also move leftwardly to the position shown in dotted lines.

Accordingly, depressing any one of push buttons 5 or 6 will cause the sliding plate associated with that push button to move leftwardly, i.e., substantially at right angles to the motion of the push buttons.

When the sliding plate moves leftwardly, pick-up stud 87 on the sliding plate will engage idler pick-up 59 of the associated idler gear and cause the idler gear to rotate, in a counter-clockwise direction, through a distance of two teeth spaces.

In operation, the device works as follows:

We will assume first that the code has been inserted (the description of code insertion will be provided below) and that the device is in its "home" condition. In the home condition:

1. The gaps in the idler gears are adjacent the timing gears so that the teeth of the idler gears and the timing gears do not mesh. However, the first tooth after the gap in the idler gear is one tooth space away from meshing with the timing gears. This is as illustrated in full lines in FIGS. 6 and 7.

2. With the idler gear in the above position, the idler gear pick-up is in position to be engaged by the pick-up stud on the associated plate.

3. The windows of the code gear are misaligned.

When a push button is depressed, as above-discussed, its associated slider moves leftwardly, and the pick-up stud on the sliding plate engages the idler gear pick-up of its associated idler gear, and rotates the idler gear through two teeth spaces. Moving through the first tooth space, the idler gear does not engage the timing gear but tooth 57' moves into the position occupied by space 57*a* so that it can engage tooth 65' of timing gear 65 when the code gear moves one more tooth space. On movement of the idler gear through the second tooth space, tooth 57 engages tooth 65' and causes timing gear 65, and therefore timing gear shaft 67, to rotate clockwise through one tooth space.

At the same time, because the teeth of the idler gear are meshed with the teeth of the associated code gear 35, the associated code gear will move through two teeth spaces while its associated idler gear is moving through two teeth spaces. However, as the code gear 35 rotates relative to its shaft 41, only the code gear associated with the idler gear will move the two teeth spaces.

When a second button is depressed, its associated idler gear will also be moved through two teeth spaces. The code gear associated with the second idler gear will also, as above, be moved through two teeth spaces.

Once again, the second idler gear will engage the timing gear only when moving through its second tooth space and will cause the timing gear to move an additional tooth space. However, when the timing gear is moving through the tooth space, the timing gear shaft, and all timing gears will also move an additional tooth space. As the teeth of the first idler gear are now in mesh with the teeth of the first timing gear, and the timing gear arrangement moves an additional tooth space, the first idler gear will also move a tooth space causing its associated code gear to move an additional tooth space. Thus, when the second push button is depressed, the first code gear will have moved through three tooth spaces. The second code gear will have moved through two teeth spaces.

The idler gears will have moved through the same number of teeth spaces as their associated code gears.

It can be seen that, when a third push button is depressed, the first code gear and the first associated idler gear will have moved through four teeth spaces, the second code gear and its associated second idler gear will have moved through three teeth spaces, and the third code gear and its associated idler gear will have moved through two teeth spaces.

Thus, if a three digit combination of four-six-two is to be a proper combination, then in the home position, the code gear associated with push button 4 would have to be offset from the aligned position in a clockwise direction by four teeth spaces, the code gear associated with push button 6 would have to be offset, from its aligned position, in a clockwise direction by three teeth spaces, and the code gear associated with push button 2 would have to be offset, from its aligned position, in a clockwise direction, by two teeth spaces.

When push button 4 is depressed, code gear 4 will move two teeth spaces towards its alignment position. When push button 6 is depressed, code gear 4 will move an additional tooth space towards its alignment position, and code gear 6 will move two teeth spaces towards its alignment position. When push button 2 is depressed, code gear 4 will move an additional tooth space towards its alignment position so that it will now be in its alignment position. Code gear 6 will move an additional tooth space towards its alignment position so that it will now be in its alignment position and code gear 2 will move two teeth spaces towards its alignment position, i.e., it will be in its alignment position.

As the remainder of the code gears will have been in their alignment position, depressing any of the wrong push buttons will throw the assembly irretrievably out of alignment until the mechanism is cleared. In addition, depressing the correct push buttons in the wrong order will also not attain complete alignment of the code gear windows.

It is also seen that the timing gear arrangement will be rotated through one tooth space, in a clockwise direction, each time a push button is depressed.

Turning now to FIG. 8, as detent gear 99 and detent wheel 97 are mounted on the same shaft 67 as the timing gears, each time the timing gear is rotated, the detent wheel will be rotated overcoming the force of detent 117. The teeth of detent gear 99, being meshed with the teeth of driver sector 101, will cause the driver sector to pivot about 115 in a counter-clockwise direction. Taking into account the fact that there are ten push buttons illustrated in the present embodiment, there are ten teeth on the driven gear sector 101. Accordingly, when the clearing arm is pivoted in a clockwise direction about pivot 109, causing the driven gear sector 101 to be pivoted likewise in a clockwise direction, the timing gear arrangement will be returned one tooth space for each push button which had been depressed. Accordingly, when the clearing arm 107 is pivoted to its full extent in the clockwise direction, the entire gear arrangement will be returned to its home position.

To insert a new combination or to change the combination, it is first necessary to have all of the code gear alignment windows in alignment. In this condition, actuator 32 is pushed so that code gears 35 are no longer in mesh with idler gears 57 (see FIG. 12). The clearing arm is then pivoted clockwise to return the timing gear assembly and the idler gear assembly to their home position, i.e., all of the idler gears are out of mesh with their associated timing gears as above described. The new permutation is then punched in. Actuator 34 is then actuated so that the code gears are once again in mesh with their associated idler gears (see FIG. 11). The clearing arm is then once again pivoted in a clockwise direction through its full extent returning the entire assembly to its home position, i.e., all of the idler gears will be out of mesh with their associated timing gears, and the alignment windows of the code gears will be offset from alignment by their appropriate amounts.

As will be clear from the above, in order to set in a new code, it is necessary to know the old code. Obviously, the lock cannot be operated unless the code is known. With presently available permutation locks, if the code is lost, then it is necessary to disassemble the entire lock in order to manually return the idler gear assembly to a home position, and to align the alignment windows of the code gear assembly so that the code gears can be moved out of mesh with their associated idler gears whereupon a new permutation can be inserted. This is, of course, a difficult and time-consuming procedure.

In order to obviate the above disadvantage, in accordance with the present invention, the code gear assembly is made removable from the remainder of the control mechanism as illustrated in FIGS. 2 and 8. When a code is lost, the control assembly is removed from its casing, and the code gear assembly is removed as shown in FIG. 2. The idler gear assembly is then returned to its home position by pivoting of the clearing arm, and the code gear assembly is manually aligned by aligning the dots 49. The code gear assembly is then replaced after having first actuated actuator 32 so that the code gears are not in mesh with their associated idler gears. The entire control mechanism is then returned to the casing, and a new permutation is then set-in as above.

Push to clear button 7 would be mounted for engagement with clearing arm 107 to cause the clearing arm to pivot as required in the particular embodiment. Push to open button 9 would be mounted for engagement with unlocking shaft 43 to cause the unlocking shaft to move in its appropriate direction depending on the embodiment.

Although in the illustrated embodiment the slides are mounted horizontally, it is within the scope of the invention to mount them vertically as well. Thus, if a lesser number of push-buttons are used, a low profile and narrow width lock can be obtained using the present invention.

Although a particular embodiment has been described, this was for the purpose of illustrating, but not limiting, the invention. Various modifications, which will come readily to the mind of one skilled in the art, are within the scope of the invention as defined in the appended claims.

I claim:

1. A permutation type lock control assembly, comprising;

a timing gear arrangement comprising a plurality of timing gears mounted on a timing gear shaft for rotation with said timing gear shaft;

an idler gear arrangement comprising a plurality of idler gears, equal to said plurality of timing gears, mounted on an idler gear shaft for rotation about said idler gear shaft, each of said idler gears being aligned with a respective one of said timing gears;

a code gear arrangement comprising a plurality of code gears, equal to said plurality of timing gears, mounted on a code gear shaft for rotation about said code gear shaft, each of said code gears being alignable with a respective one of said idler gears;

a plurality of push buttons, equal to the plurality of timing gears, each of said push buttons being associated with a respective one of said idler gears;

means connecting each of said push buttons to their associated code gears to rotate the code gears a predetermined distance when the associated push button is depressed, each said code gear being rotatable by a motion substantially perpendicular to the motion of its associated push button when its associated push button is depressed.

2. An assembly as defined in claim 1 wherein said means connecting includes a plurality of slider plates, equal to the plurality of push buttons, each of said slider plates being associated with a respective push button, each slider plate moving in a direction substantially perpendicular to the motion of its associated push button when its associated push button is depressed.

3. An assembly as defined in claim 2 wherein each idler gear comprises pick-up means;

stud means on each slider plate for engagement with the pick-up means of its associated idler gear;

wherein, when a push button is depressed, the stud pick-up means on its associated slider plate engages the pick-up means of its associated idler gear to cause rotation of the associated idler gear.

4. An assembly as defined in claim 3 wherein said means connecting further includes a plurality of crank means equal to the plurality of slider plates, each crank means being associated with a respective slider plate, said crank means being somewhat in the shape of a boomerang and having a driven leg and a free leg and mounted for pivoting between the driven and free legs;

the driven leg of each crank means being connected to its associated push button; the free leg of each crank means being connected to its associated slider plate;

whereby, motion of the push button is followed by the driven leg of the associated crank means and causes perpendicular motion by the free leg of the crank means, said perpendicular motion being transmitted to the associated slider plate.

5. An assembly as defined in claim 4 wherein each said push button comprises a stem extending inwardly from the push button;

the driven leg of each crank means being connected to the stem of its associated push button.

6. An assembly as defined in claim 5 and further including a detent disc mounted on said timing shaft for rotation therewith;

a detent gear mounted on said timing shaft for rotation therewith;

a detent ball;

said detent disc comprising a plurality of detent ball receiving spaces around the periphery thereof, each of said spaces being separated by one tooth space;

spring means urging said detent ball into a detent ball receiving space of said detent disc;

whereby, each time said timing shaft is rotated by one tooth space, said detent ball will advance from one of said detent ball receiving spaces to an adjacent one of said detent ball receiving spaces.

7. An assembly as defined in claim 6 and including a clearing arm arrangement having a sector gear;

the teeth of said sector gear being meshable with the teeth of said detent gear;

whereby, said assembly can be cleared by rotation of said clearing arm arrangement.

8. An assembly as defined in claim 7 wherein the code gear disc is associated with each said code gear of said code gear arrangement;

each said code gear disc including an alignment window;

said code gear arrangement further including an unlocking shaft, mounted parallel to said code gear shaft;

a plurality of alignment tabs on said unlocking shaft equal in number to said plurality of code gears.

9. A permutation type lock control assembly, comprising;

a timing gear arrangement comprising a plurality of timing gears mounted on a timing gear shaft for rotation with said timing gear shaft;

an idler gear arrangement comprising a plurality of idler gears, equal to said plurality of timing gears, mounted on an idler gear shaft for rotation about said idler gear shaft, each of said idler gears being aligned with a respective one of said timing gears;

a code gear arrangement comprising a plurality of code gears, equal to said plurality of timing gears, mounted on a code gear shaft for rotation about said code gear shaft, each of said code gears being aligned with a respective one of said idler gears;

a plurality of push buttons, equal to the plurality of timing gears, each of said push buttons being associated with a respective one of said idler gears;

said code gear arrangement being removably mounted in said lock control assembly.

10. An assembly as defined in claim 9 wherein said code gear arrangement is mounted in a housing;

said housing and said code gear arrangement being removably mounted in said lock control assembly.

11. An assembly as defined in claim 10 and including a code gear disc associated with each said code gear;

each said code gear disc including an alignment window;

each said code gear disc including an alignment dot;

the relationship between said alignment dots and said alignment windows of each code gear disc being alike.

* * * * *